US011649815B2

(12) United States Patent
Delaisse et al.

(10) Patent No.: US 11,649,815 B2
(45) Date of Patent: May 16, 2023

(54) CONTROLLED CRINKLE DIAPHRAGM PUMP

(71) Applicant: AMS R&D SAS, Seine Port (FR)

(72) Inventors: Guy Delaisse, Champforgeuil (FR); Jean-Baptiste Drevet, Boulogne sur Mer (FR); Harold Guillemin, Seine Port (FR)

(73) Assignee: AMS R&D SAS, Seine Port (FR)

( * ) Notice: Subject to any disclaimer, the term of this patent is extended or adjusted under 35 U.S.C. 154(b) by 66 days.

(21) Appl. No.: 16/770,445

(22) PCT Filed: Dec. 5, 2018

(86) PCT No.: PCT/EP2018/083704
§ 371 (c)(1),
(2) Date: Jun. 5, 2020

(87) PCT Pub. No.: WO2019/110695
PCT Pub. Date: Jun. 13, 2019

(65) Prior Publication Data

US 2020/0386219 A1 Dec. 10, 2020

(30) Foreign Application Priority Data

Dec. 5, 2017 (FR) ..... 17 61679

(51) Int. Cl.
*F04B 43/14* (2006.01)
*F04B 43/00* (2006.01)
*F04B 43/04* (2006.01)

(52) U.S. Cl.
CPC ..... *F04B 43/14* (2013.01); *F04B 43/0081* (2013.01); *F04B 43/04* (2013.01)

(58) Field of Classification Search
CPC ..... F04B 43/14; F04B 43/0081; F04B 43/04; F04B 43/02; F04B 43/0018; F04B 45/10; F04B 45/067; F04B 43/043; F04B 43/046
(Continued)

(56) References Cited

U.S. PATENT DOCUMENTS 6,361,284 B2 * 3/2002 Drevet ..... F04B 43/14 417/240
8,267,667 B2 * 9/2012 Freudenberger ..... F04B 43/04 417/44.1
(Continued)

FOREIGN PATENT DOCUMENTS

FR 355700 A 11/1905
FR 2497543 A1 7/1982
(Continued)

OTHER PUBLICATIONS

Full Machine Translation of Korean Patent KR 20050012675 A retrieved from Espacenet on Dec. 2, 2021. (Year: 2021).*

*Primary Examiner* — Philip E Stimpert
*Assistant Examiner* — Dnyanesh G Kasture
(74) *Attorney, Agent, or Firm* — Muncy, Geissler, Olds & Lowe, P.C.

(57) ABSTRACT

A ripple diaphragm circulator includes a body inside which there is an internal chamber comprising an inlet opening and an outlet opening for fluid; and a flexible diaphragm placed in the chamber so as to be able to ripple there. The circulator further includes an actuating mechanism including at least one motor and a mechanical linking part linking the motor to the first edge of the diaphragm so as to move it in a reciprocating motion. The circulator also includes a device for detecting at least one value representative of a movement
(Continued)

of the diaphragm, a power supply unit delivering an electrical power supply signal to the motor according to a detection signal.

14 Claims, 4 Drawing Sheets

(58) Field of Classification Search
USPC ..... 417/413.1, 413.2, 413.3
See application file for complete search history.

(56) References Cited

U.S. PATENT DOCUMENTS

2002/0146333 A1* 10/2002 Drevet ..... F04F 7/00 417/436
2008/0232987 A1* 9/2008 Drevet ..... F04B 43/0018 417/478
2009/0026881 A1* 1/2009 Erturk ..... F04D 33/00 323/204
2011/0150669 A1* 6/2011 Frayne ..... F04B 43/14 417/53
2013/0272902 A1* 10/2013 Noth ..... F04B 43/0081 417/53
2015/0330383 A1* 11/2015 Letailleur ..... F04B 43/0054 417/472
2019/0064104 A1* 2/2019 Mou ..... G01N 1/2273
2020/0266692 A1* 8/2020 Trumper ..... H02K 41/031

FOREIGN PATENT DOCUMENTS

FR 2891321 A1 3/2007
FR 3021074 A1 11/2015
KR 20050012675 A * 2/2005 ..... G01H 9/00
WO WO-2007/063206 A1 6/2007

* cited by examiner

CONTROLLED CRINKLE DIAPHRAGM PUMP

BACKGROUND OF THE INVENTION

The invention relates to the field of ripple diaphragm circulators.

Known, for example from document WO2007063206, is a ripple diaphragm circulator comprising:

- a body inside which there is a chamber internal to the body, this chamber comprising an inlet opening for fluid into the chamber and an outlet opening for fluid out of the chamber;
- a flexible diaphragm placed in the chamber so as to be able to ripple there between first and second edges of the diaphragm, the first diaphragm edge being located closer to the fluid inlet opening than to the fluid outlet opening and the second diaphragm edge being located closer to the fluid outlet opening than to the fluid inlet opening; the circulator further comprising:
- an actuating mechanism including at least one motor and at least one mechanical linking part linking the motor to the first edge of the diaphragm so as to move it in a reciprocating motion relative to the body in order to generate a ripple on the diaphragm propagating from the first diaphragm edge to the second diaphragm edge.

This ripple allows fluid to be drawn from the fluid inlet opening to the fluid outlet opening. Due to its reciprocating motion, the circulator may generate vibrations which it would be desirable to control in order, for example, to envisage an increase in the service life of the circulator.

OBJECT OF THE INVENTION

An object of the invention is to provide a means for controlling parameter(s) influencing circulator vibrations.

SUMMARY OF THE INVENTION

To this end, what is proposed according to the invention is a ripple diaphragm circulator comprising:

- a body inside which there is a chamber internal to the body, this chamber comprising at least one inlet opening for fluid into the chamber and at least one outlet opening for fluid out of the chamber;
- a flexible diaphragm placed in the chamber so as to be able to ripple there between first and second edges of the diaphragm, the first diaphragm edge being located closer to the fluid inlet opening than to the fluid outlet opening and the second diaphragm edge being located closer to the fluid outlet opening than to the fluid inlet opening; the circulator further comprising:
- an actuating mechanism including at least one motor and at least one mechanical linking part linking the motor to the first edge of the diaphragm so as to move it in a reciprocating motion relative to the body in order to produce a ripple on the diaphragm propagating from the first diaphragm edge to the second diaphragm edge.

This circulator according to the invention is primarily characterized in that it also includes a device for detecting at least one value representative of a movement of the diaphragm relative to the body, this detection device being functionally linked to a motor power supply unit, this power supply unit being arranged to deliver at least one electrical power supply signal to the motor according to a detection signal delivered to the power supply unit by said detection device, this detection signal being dependent on said at least one detected value.

Detecting a value representative of the movement of the diaphragm and then generating a detection signal representative of this at least one detected value and finally controlling the motor via said at least one motor electrical power supply signal which is itself dependent on a detection signal allows the operation of the motor to be controlled and consequently makes it possible to act on the movement of the diaphragm in the body.

Since circulator vibrations depend primarily on the propagation characteristics of the wave along the diaphragm, by providing a means for controlling the motor according to the movement of the diaphragm, a means for controlling parameters influencing circulator vibrations is provided.

This has many advantages since it may influence the service life of the circulator by adjusting its operation according to the movements of the diaphragm in the body.

This control allows the circulator to be feedback-controlled according to the movement of the first edge of the diaphragm which makes it possible, in addition to controlling the frequency and/or the amplitude of movement of the diaphragm edge, to vary the hydrodynamic characteristics of the circulator at any given time, i.e. the flow rate of pumped fluid, the pressure difference between the inlet and the outlet of the chamber, the curve of change over time of the flow rate and/or of the chamber outlet pressure.

In one preferred embodiment of the invention, the actuating mechanism is arranged so as to define a maximum amplitude MAX of the reciprocating motion of the first edge of the diaphragm that is variable according to said at least one electrical power supply signal delivered to the motor.

The motor is thus a motor of which the maximum amplitude of oscillation/the maximum travel of the rotor relative to the stator is variable according to said at least one motor electrical power supply signal.

In the present invention, the term rotor refers to the portion of the motor which is movable relative to the stator without implying that this movability is necessarily a rotation. In this case, in the present invention the rotor may be movable linearly or mainly linearly relative to the stator. For the understanding of the invention, a linear motor is any motor of which the rotor, over one complete motor cycle, moves relative to the stator following a trajectory which runs along a line segment, passing through the ends of this line segment and without ever deviating from this line segment by a distance greater than 10% of the length of this line segment. The power supply unit may thus adjust the distance between the edge of the diaphragm and the wall of the chamber in order to vary the "occlusivity", i.e. the minimum fluid flow area allowed by the diaphragm at any given time in its ripple.

This minimum allowed fluid flow area is the smallest flow area allowed at any given time between the fluid inlet opening and the fluid outlet opening. It should also be noted that by adjusting the maximum amplitude of movement of the diaphragm as well as its frequency of oscillation and by following a movement imparted in the movement time for the first edge of the diaphragm relative to the support, the power supply unit may define the variation in the wavelength traveling along the diaphragm and consequently the number of inflections in the wave traveling along the diaphragm in the chamber.

For a given minimum flow area value, the more inflection points there are in the wave of the diaphragm, the greater the pressure difference permitted by the circulator between the fluid inlet opening and the fluid outlet opening. The fluid head permitted by the circulator may thus be controlled.

Thus, the circulator according to the invention, by allowing regulation of said at least one motor power supply signal taking into account the one or more values detected and representative of the movement of the first edge of the diaphragm, makes it possible to regulate the amplitude of movement of the first upstream edge and/or the frequency of oscillation of this first edge and/or the force applied to this first edge of the diaphragm and/or the curve of movement over time of this first edge of the diaphragm.

Thus, the circulator makes it possible to control the minimum flow area value through the chamber and the number of inflections in the diaphragm which affects the fluid flow rate and the fluid pressure delivered by the circulator.

The invention will be described in more detail with reference to the drawings described below.

DETAILED DESCRIPTION OF THE INVENTION

Figure 1:
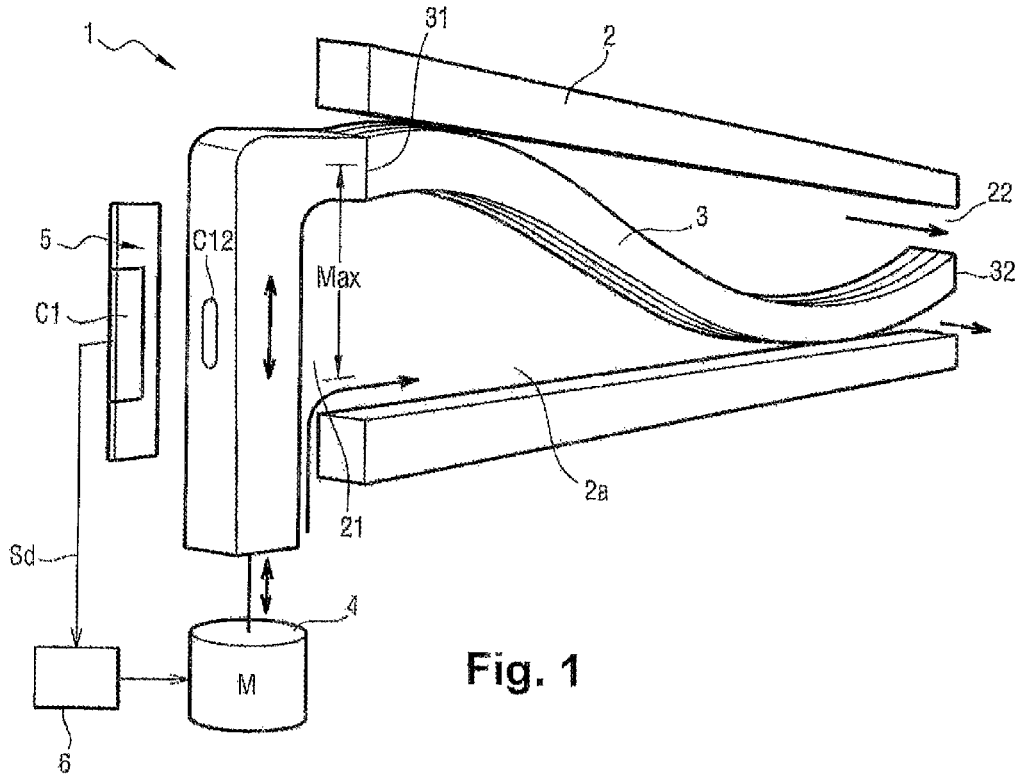
FIG. 1 is a perspective view of one embodiment of the circulator 1 with a ripple diaphragm according to the invention, this circulator including a diaphragm placed in a chamber formed in a body of the circulator so as to ripple there under the effect of a movement generated by a motor M with regulation of the electrical power supply signal for this motor according to a measurement of the movement of a first edge of the diaphragm using a position sensor which comprises a target attached to the first diaphragm edge, and a means for detecting the position of this target relative to the stator of the motor (in this example, the target is a permanent magnet)

As indicated above and illustrated in particular by FIGS. 1 to 4, the present invention relates primarily to a ripple diaphragm circulator 1 comprising:

- a body 2 inside which there is a chamber 2*a* internal to the body, this chamber 2*a* comprising at least one inlet opening 21 for fluid into the chamber 2*a* and at least one outlet opening 22 for fluid out of the chamber;
- a flexible diaphragm 3 placed in the chamber so as to be able to ripple there between first and second edges of the diaphragm 31, 32, the first diaphragm edge 31 being located closer to the fluid inlet opening 21 than to the fluid outlet opening 22 and the second diaphragm edge 32 being located closer to the fluid outlet opening 22 than to the fluid inlet opening 21; the circulator further comprising:
- an actuating mechanism 4 including at least one motor M and at least one mechanical linking part 41 linking the motor M to the first edge of the diaphragm 31 so as to move it in a reciprocating motion relative to the body 2 in order to produce a ripple on the diaphragm 3 propagating from the first diaphragm edge 31 to the second diaphragm edge 32. This reciprocating motion of movement of the first edge of the diaphragm 31 is here a reciprocating linear motion.

For the understanding of the invention, a linear reciprocating motion refers to a movement of a given point or object which, over one complete reciprocation cycle, follows a trajectory which runs along a line segment, passing through the ends of this line segment, without ever deviating from this line segment by a distance greater than 10% of the length of this line segment.

Preferably, the first diaphragm edge is stiffened by a reinforcement in order to limit its deformation when this first edge is moved according to the reciprocating motion. There is thus a uniform movement of the first edge of the diaphragm which limits the occurrence of secondary waves on the diaphragm.

The circulator according to the invention has a device 5 for detecting at least one value representative of a movement of the diaphragm 3 relative to the body 2.

This detection device 5 is functionally linked to a motor power supply unit 6, which may be an inverter. Depending on the case, this inverter may be connected to a DC or AC electrical power supply network, which may be single-phase or polyphase.

This power supply unit 6 is arranged so as to deliver at least one electrical power supply signal to the motor according to a detection signal Sd delivered to the power supply unit 6 by said detection device 5, this detection signal Sd being dependent on said at least one detected value.

The invention makes it possible to regulate the motor according to the actual movement of the diaphragm in the chamber, this movement being estimated by measuring at least one value representative of this movement by means of said detection device 5.

By virtue of this regulation via said at least one power supply signal, the movement of the diaphragm may be controlled so that the circulator adopts an expected operating point. The operating point is a state of various operating parameters of the circulator at a given time in operation.

Depending on the case, the circulator may be feedback-controlled so as to limit the vibration level produced during its operation and thus limit the energy lost through contact of the diaphragm against the wall of the chamber and/or the energy lost in the form of an impact of the diaphragm against the wall. Thus, the service life of the circulator may be improved.

Of course, this control may be used to reach a desired operating point of the circulator where the flow rate and/or the pressure difference between the upstream and downstream of the circulator and/or the ripple frequency and/or the ripple wavelength is/are chosen as setpoints to be reached and as a basis for determining the change over time in said power supply signal to be generated.

For this, the detection device 5 is preferably arranged so that said detection signal Sd delivered to the power supply unit 6 is dependent on measurements taken by at least one sensor C1 of said detection device 5 chosen from the group of sensors comprising a Hall effect sensor, resolver sensor, incremental encoder, an optical sensor using a light beam to measure a movement parameter of a diaphragm surface, a laser sensor using a laser beam to measure a movement parameter of a diaphragm surface, an optical sensor using a light beam to measure a movement parameter of a target, a laser sensor using a laser beam to measure a movement parameter of a target, an accelerometer, a capacitive sensor, an inductive sensor, a resistive sensor, a camera associated with an image analysis system, an infrared sensor, an eddy current sensor.

This or these sensors may be arranged so as to measure a position, a speed, or an acceleration representative of the movement of the first edge of the diaphragm.

The incremental encoder may be a rotary encoder for incrementing a value according to an angle of rotation or be a translational encoder incrementing a value according to a distance of translation.

Additionally, said at least one sensor C1 of the detection device may have a target C12 mechanically linked to any region of the diaphragm and more particularly to the first edge of the diaphragm 31, the value representative of a movement of the diaphragm varying during the movement of this target C12 relative to the body of the circulator 2. Ideally, the target C12 is fixed to the diaphragm.

The target may be a target the movement of which may be detected by measuring a magnetic and/or electric and/or electromagnetic field varying with the movement of the target.

It is also possible for the sensor C1 to be able to detect a relative motion of the diaphragm with respect to the body without using a target. Thus, the optical or laser sensor may measure the movement of any point on the diaphragm whether or not the latter bears an attached target.

It is also possible to envisage the detection device 5 being arranged so that said detection signal Sd delivered to the power supply unit 6 is dependent on measurements taken by at least one sensor C1 of said detection device 5 chosen from the group of deformation sensors comprising:

- a sensor for detecting the deformation of said at least one mechanical linking part 41 linking the motor to the first edge of the diaphragm;
- a sensor for detecting the deformation of at least one spring 42 exerting an elastic force that is variable according to the movement of the first edge of the diaphragm by the motor;
- a deformation sensor attached to (for example fixed to or incorporated within) the diaphragm, for example at the first edge of the diaphragm or at the second edge of the diaphragm, or at any location between these edges, for measuring deformations of the diaphragm;
- a sensor for detecting at least one mechanical stress to which said mechanical linking part 41 is subjected;
- a sensor for detecting at least one mechanical stress to which said at least one spring 42 is subjected.

Figure 2:
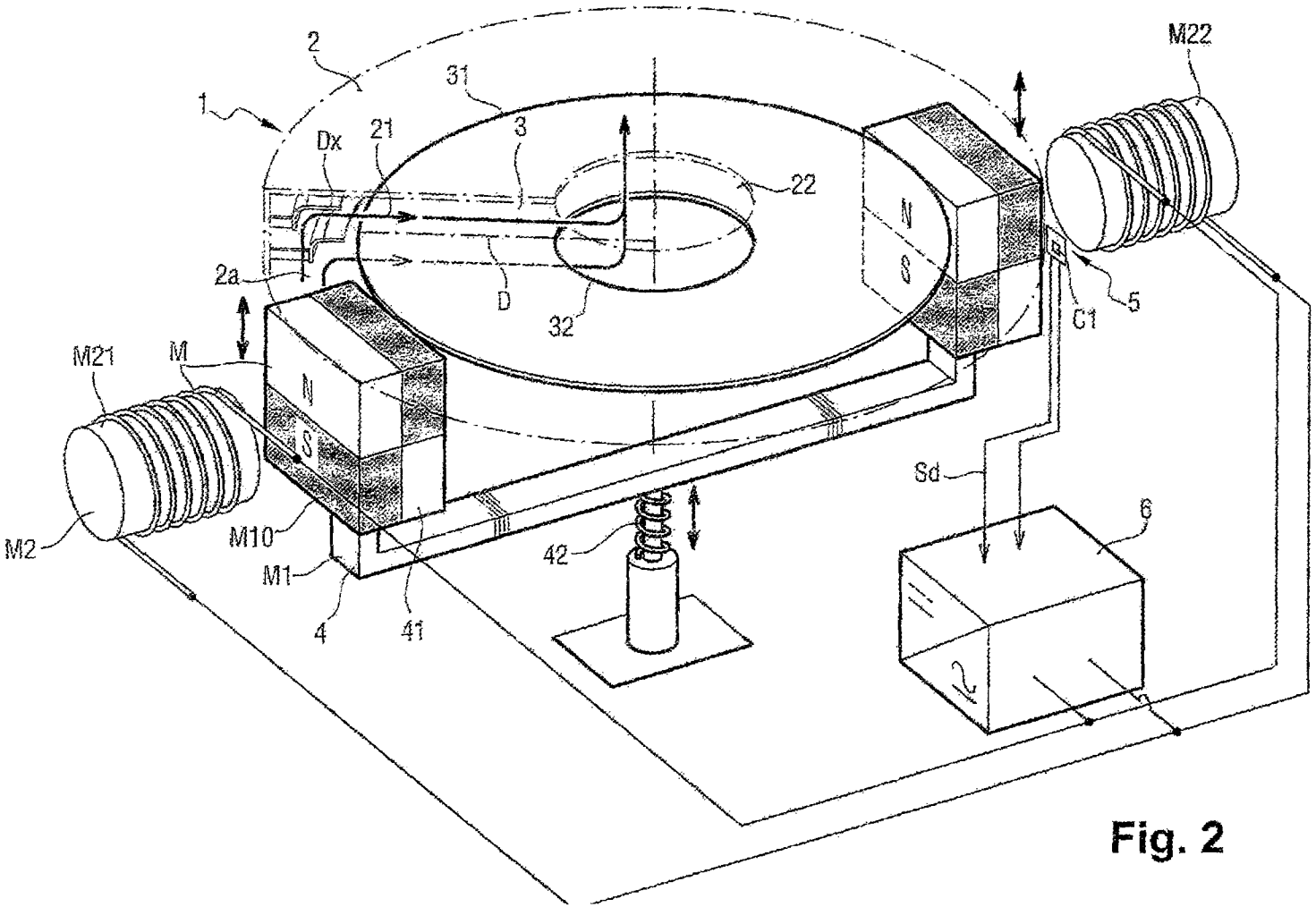
FIG. 2 is a perspective view of another embodiment of the circulator according to the invention in which the diaphragm is discoidal, whereas the diaphragm of FIG. 1 is in the shape of a ribbon.
Figure 4:
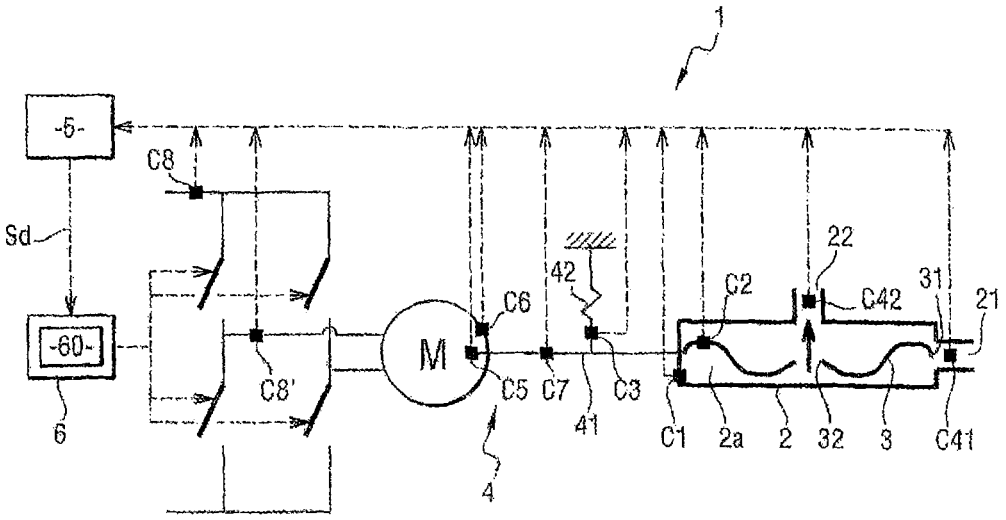
FIG. 4 illustrates a schematic view of the circulator according to the invention with a power supply unit which comprises means for communicating the supply of power to different coils of the motor and a detection device generating a detection signal using measurements of values representative of a movement of the diaphragm which are generated via at least one sensor, in this case via a plurality of sensors belonging to the detection device.

As can be seen in particular in FIGS. 2 and 4, a spring may be mechanically linked to the mechanical linking part 41 which mechanically links, directly or indirectly, the motor to the first edge of the diaphragm 31. This spring 42 represents any elastic means arranged to exert an elastic force for returning the mechanical linking part 41 and the first diaphragm edge 31 to a given stable position.

The spring may be a leaf spring comprising one or more elastic leaves and/or one or more helical springs.

Ideally, the movement of the mechanical linking part is guided by guide means which may be formed either exclusively by the elastic means or by a pivot or slide guide as in FIG. 2, potentially associated with elastic means.

It is also possible to envisage the detection device 5 being arranged so that said detection signal Sd delivered to the power supply unit is dependent on measurements taken by at least one sensor of said detection device chosen from the group of sensors comprising:

- a sensor for measuring mechanical force (such as a force sensor for example placed at the interface between the mechanical linking part 41 and the first edge of the diaphragm);
- a magnetic field sensor;
- a voltage sensor;
- a rotation/angular movement sensor (C7) (for rod/crank rotary motors for example);
- a translational movement sensor (for linear motors for example);
- a current sensor (C8, C8').

The motor M includes a movable rotor M1, i.e. an assembly movable by rotation, translation or the like relative to a stator M2 of the motor.

This rotor M1 comprises at least one permanent magnet M10, in this case at least two permanent magnets distributed symmetrically relative to the first diaphragm edge.

The stator M2 comprises at least one stator coil, in this case two coils M21, M22 arranged facing paths followed by the permanent magnets during the reciprocating motion of the first edge.

Each coil is suitable for generating a magnetic flux in response to said at least one electrical power supply signal from the motor M, this magnetic flux acting on the permanent magnets to produce a force of attraction to or repulsion from the permanent magnet and thus generate a movement of the rotor relative to the stator.

The motor electrical power supply signal is delivered to each at least one coil M21, M22 by the motor power supply unit 6. A stator coil is a stator winding, i.e. a conductive wire wound around a core and assembled so as to be able to remain fixed relative to the body of the circulator.

Preferably, the motor is a brushless motor, or self-controlled permanent-magnet synchronous machine, this motor including a structure to which said rotor position sensor is secured, said at least one permanent magnet of the rotor being mounted movably relative to this structure and said rotor position sensor preferably being a sensor measuring the position of said at least one permanent magnet relative to this structure of the motor.

In this case, the detection device 5 may include at least one position sensor C5, C6 for detecting the position of the rotor relative to said at least one stator coil M21, M22. Conversely, it is possible for the sensor to be placed on the rotor itself, this sensor being for example an accelerometer.

In the case that driving is performed by a brushless motor, it is preferable to ensure that any movement of the rotor is associated with a corresponding movement of the first diaphragm edge 31.

Thus, a sensor integrated within the brushless motor may be used to measure the movement of the rotor relative to the stator of the motor, the detection device being linked to this sensor integrated within the brushless motor and being suitable for generating said detection signal Sd according to a value measured using this sensor integrated within the brushless motor.

This or these sensors integrated within the motor may be one or more Hall effect current sensors associated with a program for measuring the force and the speed (frequency) of the rotor.

In this way, the need to add sensors other than that already integrated within the motor is limited.

When the viscosity of the fluid at the head of the circulator and the hydraulic head are known, determining the force, by means of a sensor integrated (or otherwise) within the motor, makes it possible to determine the position of the first edge of the diaphragm relative to the body.

It is also possible to envisage the power supply unit 6 being arranged so that said at least one motor M power supply signal which said unit generates is dependent on measurements taken by at least one sensor of said detection device 5 chosen from a group of sensors for detecting one or more hydraulic or aeraulic characteristics of the fluid comprising:

- at least one sensor C41 for detecting the flow rate of fluid pumped by the circulator;
- at least one sensor C42 for detecting the pressure of fluid pumped by the circulator;
- at least one sensor for detecting the viscosity of fluid.

Ideally, as illustrated in FIG. 4, the power supply unit 6 includes a computer 60 arranged so as to define characteristics of said at least one motor M power supply signal using mathematical functions and/or using a map database for the circulator and/or logical operators (IF THEN) and according to pressure values and flow rate values of the fluid flowing through the circulator chamber, these values being measured using a flow rate sensor C41 and at least one pressure sensor C42.

It should be noted that it is possible to use a pressure sensor upstream of the chamber and a pressure sensor C42 downstream of the chamber in order to measure the change over time in the difference between the upstream fluid pressure and the downstream fluid pressure.

This information makes it possible to deduce the frequency of movement of the first diaphragm edge and the speed of movement of the fluid according to variations in this difference.

The map may define a plurality of operating points constituting relationships between the amplitude of movement of the first diaphragm edge, fluid viscosity, fluid flow rate produced by the circulator, upstream and downstream pressure difference and frequency of reciprocating motion of the first diaphragm edge relative to the body.

By virtue of knowing some of these parameters, for example because they are predetermined/fixed and measured, it is possible to know the effect of a variation in the motor power supply signal on the change in one of these parameters that is sought to be regulated.

Thus, if the parameter to be regulated is the amplitude of movement of the upstream edge of the diaphragm in order to ensure that the diaphragm does not collide with the wall of the chamber, then the computer 60:

- knowing the viscosity of the fluid, and the measured values of fluid flow rate produced by the circulator, the upstream and downstream pressure difference and the frequency of reciprocating motion of the first diaphragm edge relative to the body;
- is able to deduce from the map database the current value of the amplitude of movement of the first diaphragm edge relative to the body; and
- to define a target value to be reached for the amplitude of movement of this first edge; and
- the computer deducing the characteristics of the power supply signal to be delivered in order to reach this target value at a given time.

The movement of the diaphragm thus remains under control so as, for example, always to keep this diaphragm away from the walls of the chamber or a certain predetermined distance away from these walls of the chamber.

It is also possible, via the power supply signal, to seek to control the circulator to reach a target value of one of these mapped parameters.

A target/setpoint value may be the pressure difference or a target flow rate value.

The computer 60 uses the map and/or the mathematical functions and/or the database and/or logical operators (IF THEN) and the detection signal Sd to determine the power supply signal to be generated in order to reach this chosen target value.

The map database may be generated via multiple circulator tests in order to determine a plurality of operating points therefrom.

Each given operating point defines the values taken by the various operating parameters of the circulator, these parameters comprising:

- viscosity of the fluid; and/or
- fluid flow rate; and/or
- upstream and downstream pressure difference (i.e. the head parameter of the circulator); and/or
- relative pressure upstream and/or downstream with respect to a pressure between the ambient atmosphere; and/or
- frequency of reciprocating motion of the first diaphragm edge relative to the body; and/or
- amplitude of movement of the first diaphragm edge; and/or
- variation in force delivered by the motor; and/or
- the elastic stiffness of the diaphragm; and/or
- the elastic stiffness/elastic stiffness curve of an elastic means such as a spring forcing the first diaphragm edge to return to a determined position; and/or
- the corresponding characteristics of each at least one motor power supply signal such as the frequency of the signal, its intensity, its voltage, its curves of variation in voltage or intensity over time.

Typically, the actuating mechanism 4 is arranged so as to define a maximum amplitude MAX of the reciprocating motion of the first edge 31 of the diaphragm that is variable according to said at least one electrical power supply signal delivered to the motor M.

This rule of varying the maximum amplitude MAX according to the electrical power supply signal delivered to the motor M is preferably integrated within the map database.

It is thus possible to regulate the power supply signal so as to vary the maximum amplitude of movement of the first edge over a plurality of successive reciprocations of the motion of the diaphragm.

In this context, it is possible to ensure that the actuating mechanism 4 includes an electromechanical assembly for varying the amplitude distinct from said motor.

This electromechanical assembly, which comprises said part linking the motor to the first edge of the diaphragm, is here arranged so as to define a maximum amplitude of the reciprocating motion of the first edge of the diaphragm that is variable according to a maximum amplitude setpoint delivered by an amplitude control unit to said electromechanical assembly.

There are therefore several ways of varying the amplitude MAX over time, either by controlling the motor via the power supply signal, or by controlling an electromechanical assembly distinct from the motor via an amplitude setpoint signal which is distinct from the motor power supply signal. This embodiment may be advantageous for the case in which it is desired to control the amplitude of movement of the first diaphragm edge using a motor which has a fixed/invariable maximum amplitude of movement.

In this embodiment (not illustrated by the figures), the mechanical linking part may be an arm pivoting about a pivot axis, an electromechanical actuator acting on the position of this pivot axis relative to this pivoting arm or on the length of this arm, which is variable, in order to define an amplitude of movement of the diaphragm edge without having to vary the travel/maximum amplitude of the motor.

It should be noted that the value representative of the movement of the diaphragm relative to the body may be a maximum amplitude of movement measured from the first edge of the diaphragm 31 relative to the body 2.

As illustrated in FIG. 4 and discussed above with reference to the different groups of possible sensors, the detection device 5 may include one or more sensors (each sensor is represented by a black rectangle) arranged in one or more different locations of the circulator 1, in this case on the electronic portion and/or the electrical power supply portion of the motor and/or the electromechanical portion of the motor and/or the electromagnetic portion of the motor and/or the hydraulic portion of the circulator and/or preferably on the mechanical linkage between the motor and the first edge of the diaphragm.

It is preferable to use at least one sensor on the mechanical linkage between the motor and the first diaphragm edge because it is at this location that the most reliable measurement possible of movement parameters of the first diaphragm edge may be obtained, i.e. its position and/or its speed and/or its frequency and/or its acceleration and/or the force transmitted to this first edge and/or the maximum amplitude of movement of the first edge.

To measure one or more values representative of the movement of the first edge of the diaphragm 31, the detection device 5 may include a plurality of sensors of different types chosen, for example, from a Hall effect sensor C5, a synchro C6, an incremental encoder C7.

Figure 3A:
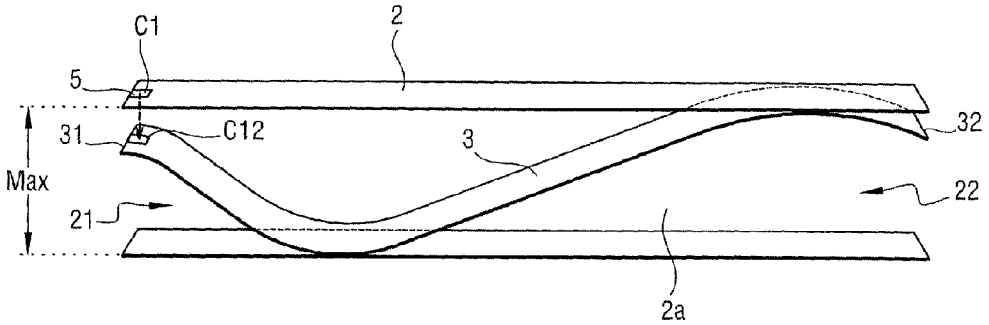
FIGS. 3*a*, 3*b* and 3*c* show a schematic view of a ripple diaphragm in the chamber with a device for detecting a value representative of the movement of the diaphragm which is here a sensor detecting the position of the first edge of the diaphragm, this sensor being for example a preferably analog proximity sensor detecting the position of the first edge of the diaphragm relative to a fixed point of the chamber.
Figure 3B:
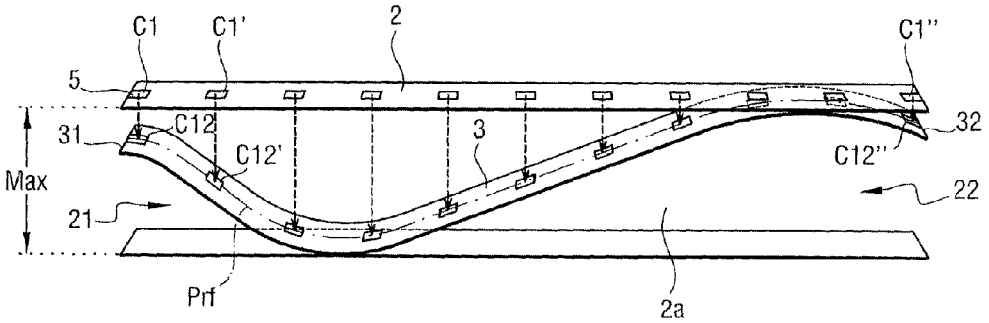
Figure 3C:
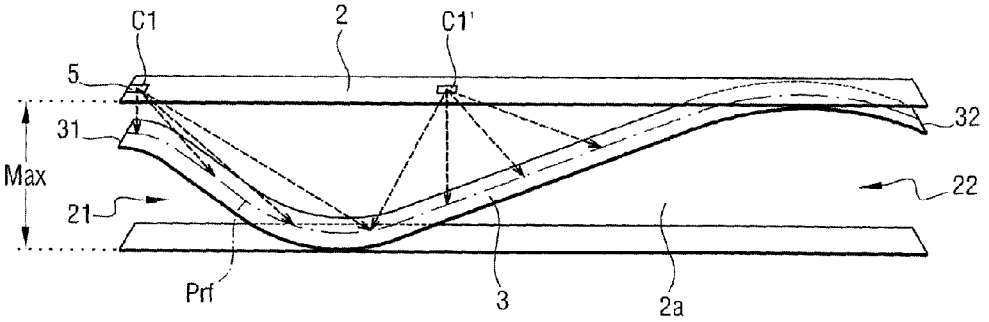

As illustrated in FIGS. 3*b* and 3*c*, it is also possible for the detection device 5 to be arranged so as to detect the respective positions of a plurality of points on the diaphragm relative to the body 2.

For example, the detection device may be arranged so as to collect images of a longitudinal profile Prf of the diaphragm extending between the first and second edges of the diaphragm 31, 32 in order to detect said positions of a plurality of points on the diaphragm, these points belonging to said longitudinal profile of the diaphragm.

To this end, as illustrated in FIG. 3*b*, the detection device may include a plurality of sensors C1, C1', C1" distributed over the body facing a longitudinal profile Prf of the diaphragm running from the first diaphragm edge toward the second diaphragm edge. This profile extends along the diaphragm.

These sensors C1, C1', C1" may each be associated with a corresponding target C12, C12', C12" borne by the diaphragm and/or by the body so as to measure relative positions, each relative position illustrating a position of one of said sensors C1, C1', C1" with respect to one of said targets C12, C12', C12" which corresponds thereto.

Alternatively, as illustrated in FIG. 3*c*, the detection device may comprise an imaging device comprising a light source, such as a laser source generating a diaphragm illumination plane extending along the diaphragm from the first edge toward the second edge of the diaphragm 31, 32. In this case, the positions of illuminated points on the diaphragm are evaluated by one or more sensors C1, that detect light rays reflected by the diaphragm or potentially reflected by reflective targets borne by the diaphragm. The positions of these points measured at a given time may define a longitudinal profile Prf of the diaphragm at this given time.

Alternatively, the detection device may be arranged to collect images of a surface of the diaphragm, this surface extending between the first and second edges of the diaphragm 31, 32, in order to detect said positions of a plurality of points on the diaphragm, these points belonging to a surface shape of the diaphragm in three dimensions so as to define a three-dimensional image of this diaphragm and its change over time.

It should be noted that in the cases in which a light beam or optical sensors are used to capture an image of the diaphragm, it is possible to make the body at least locally transparent so as to see therethrough or alternatively to give the sensor a viewing window oriented into the interior of the chamber.

As illustrated in FIG. 2, the circulator may include at least one fluid deflector Dx positioned in the chamber 2*a* and connected to the body 2 in order to direct the fluid arriving in the chamber via the fluid inlet opening toward the first diaphragm edge in a direction D running from this first diaphragm edge to the second diaphragm edge. A sensor for detecting the movement of the first diaphragm edge belonging to the detection device may be attached to this deflector Dx.

The diaphragm 3 takes, for example, a general shape selected from the group of diaphragm shapes comprising a discoidal shape, a rectangular shape, a tubular shape. Thus, in FIGS. 1 and 3*a* to 3*c*, the diaphragm is in the shape of an elongated ribbon, and in FIGS. 2 and 4, it is in the shape of a discoid with a void in its center.

The diaphragm may be made of one or more materials selected from flexible elastomers—NBR—NR—EPDM—VMQ—PU—other food-grade materials (CR—PDM—peroxide—FKM—virgin PTFE)—PVC—silicone and/or metal materials such as stainless steel.

The interaction between the sensor and its "target", which may be the diaphragm edge itself or a target borne by this first edge, may be achieved by means of a camera associated with an image analysis system, or of a system for measuring a magnetic field if the target generates a magnetic field, with the target being a magnet or an inductor, or electric field if the target is a current conductor, or an electromagnetic field.

The sensor may also be optical and be provided with a device for optically illuminating the target (the first diaphragm edge constituting the target or bearing the target), this illumination being via a beam such as an infrared or laser beam. In this embodiment, the sensor includes a device sensitive to a reflection of the beam off the target, such as a photosensitive cell. The closer the target is to the sensor, the greater the intensity of the reflected beam, which makes it possible to know the position of the first edge of the diaphragm relative to the sensor.

The circulator according to the invention may be a liquid circulator, a gas circulator, a pump, a fan, a compressor, or a propeller.

Some advantages of the invention will be listed below:

Optimal Occlusivity: Feedback on the position of the diaphragm makes it possible to control the circulator to ensure an optimal given occlusivity regardless of the head to which the circulator is subjected (fluids with variable viscosity, presence of particles, head losses, etc.). It is possible to ensure optimal efficiency and hydraulic power by modulating the amplitude and/or frequency of ripple, i.e. the torque and speed of the motor. The risk of flow reversal, known as "backflow", with a flow going from the outlet toward the inlet of the chamber, may be managed. In the case of a low hydraulic power requirement and when the occlusivity cannot be observed, controlling the amplitude/frequency pair makes it possible to minimize this backflow.

Managed Shear Stresses: The detection device and its one or more sensors allow fine control of the minimum distance between the diaphragm and the chamber wall as well as the wave propagation characteristics along the diaphragm, thus limiting fluid shear stresses. This is particularly advantageous for certain applications such as in cardiac assist circulators in which the physicochemical structure of the transported fluid is liable to change in the event of shear above a predetermined threshold.

Simplicity of Implementation: The detection device and its one or more sensors may be very simple to implement, for example by positioning a Hall effect sensor on the stator facing the rotor and its permanent magnet (as for brushless motors).

Operation Indicator: The detection device and its one or more sensors make it possible to provide other indications regarding the operation of the circulator which are correlated with the position of the diaphragm, such as for example the position of the rotor, or the flow rate and the pressure for a given fluid viscosity, or finally, quite simply, whether the circulator is operating or not.

Indicator Regarding the Pumped Fluid: Measuring the position of the first diaphragm edge also makes it possible to provide an indication regarding the viscosity of the pumped fluid, in particular by virtue of a map database generated with a given fluid, or by virtue of calibration of the circulator performed with a fluid of given viscosity. Thus, knowing the characteristics of the power supply signal, for example the electrical power delivered to the motor and the amplitude obtained via the detection device, it is possible, using the map data, to deduce the viscosity of the fluid therefrom. Thus, the invention may relate to a method for measuring the viscosity of fluid flowing through the chamber of the circulator according to the invention. This method consists in applying a predetermined power supply signal to the motor and in measuring the amplitude of the first diaphragm edge brought about by this actuation of the motor, and then, according to this measured amplitude and to the data from a map associating power supply signal data with diaphragm movement amplitude data and fluid viscosity data, a value representative of the viscosity of the fluid actually pumped is deduced. For the same electrical power, there will be a greater amplitude with a less viscous fluid than with a more viscous fluid.

Flexible Control Speed: The processing of the information from the one or more sensors may be matched to the complexity of control of the motor to be implemented. The speed of control of the movement of the diaphragm depends on the speed with which it has to be controlled: control over each peak amplitude/oscillation thereof, or control over a greater period (control over a plurality of oscillations/amplitudes—possible decrease in the sensor sampling frequency), or infrequent control to check that the circulator is functioning properly. In this case, the invention may also relate to a method for estimating the operating state of the circulator which consists in applying a motor power supply signal and in observing the amplitude of the first edge of the diaphragm while a liquid of known viscosity flows through the chamber, then generating a circulator state signal according to the value taken by the measured amplitude. Depending on this state signal, the power supply unit may order the supply of power to the motor to stop and the generation of an alarm or conversely continue with this power supply. Additionally, control may be performed according to any type of control/corrector: on/off, proportional, proportional-integral-derivative, fuzzy logic, among others. Feedback-controlling the movement of the excited side of the diaphragm may therefore result in a real-time modification in the PWM control of the power bridge (i.e. said power supply switching means), in the case that the actuator is supplied with power by an inverter, a modification which takes place more or less often depending on the desired speed of control of the circulator.

Volumetric Measurement: According to the viscosity of the fluid and the head, the detection device and its one or more sensors allow precise control of the pumped flow rate and of the delivered pressure (advantage of volumetric circulators such as peristaltic circulators, piston circulators, or diaphragm circulators). The feedback-control of the system in terms of flow rate or pressure is improved.

Safe Circulator: The circulator is made more reliable, thus avoiding any excessively high amplitude which would negatively affect the system, make noise, and consume power unnecessarily, for example when the quality factor of the system is very good (operation at resonant frequency, no friction between the movable portion and the other components by virtue of being well guided by the springs), leading to divergent oscillations, of increasing size, or even, in the case of variable hydraulic heads, leading to variable diaphragm oscillations for the same mechanical power (for a valve closure for example, the amplitude sometimes increases by up to 60% compared to the open valve amplitude). This also makes it possible to detect any abnormal movement of the diaphragm/any abnormal operation of the circulator: blockage, breakage, "lambada" of the movable portion. In the case that the circulator has to self-prime, it must then start by running empty. The movement sensor then has the advantage of avoiding any runaway of the motor (due to a low load) and of making the circulator safe. The safety and service life of the system (head of the circulator, motor, electronics), that of the hydraulic circuit, and more generally the safety of the environment of the circulator (in particular that of the user) are thereby improved.

Hardware Control: Like for rotary brushless motors, position control may be achieved by means of hardware, decreasing the costs associated with software control (see FIG. 1). This type of control has the particularity of allowing the rotor to oscillate exactly at the resonant frequency of the system, the oscillation not being forced.

Adjusting the Waveform: For a fluid or a load, this measurement may be used to adjust the shape (generally sinusoidal) of the current in the motor in order to improve the ripple of the diaphragm and find the optimal control strategy (triangle, square, sine with an offset in order to raise or lower the midpoint of oscillation of the diaphragm, pulse, any periodic sequence, etc.), and thus improve the efficiency of the system. This detection device and its one or more sensors therefore make it possible to automate the control of the circulator.

Circulator Calibration: Measuring the position of the diaphragm may be useful in calibrating the circulator during its manufacture or maintenance, in order to adjust the circulator parameters so that they are the best possible: increasing the number of motor turns, modifying the spacing of plates forming opposite walls of the chamber, replacing parts, modifying the diaphragm oscillation midpoint by adjusting the position of the diaphragm support, modifying the resonant frequency by changing the spring. For certain applications for which the hydraulic head does not change, or for those which do not provide a critical function, this calibration may be the only time in the service life of the circulator during which a sensor will be connected thereto.

Freeing Up Space in the Head of the Circulator (Here the Head Refers to the Body of the Circulator): This position measurement also makes it possible to be able to place the diaphragm where desired between these two plates, for example by pressing the diaphragm against a plate so as to pass a bulky object through the head of the circulator which could not have passed through with the diaphragm located in the middle, or to avoid any head loss caused thereby when filling its hydraulic circuit or subjecting it to high/low pressure.

Use of Several Sensors: Incorporating a plurality of sensors into the detection device of the circulator allows the circulator to be made more reliable or the measurements to be made more accurate through information redundancy. These sensors may in particular be positioned at different locations on the upstream edge of the diaphragm in order to provide a picture of the complete oscillation of this upstream edge and to detect any anomaly, such as the abnormal ripple of a portion of the edge ("lambada" of the movable portion). In the case of motors with a plurality of phases and a plurality of mechanical linking parts, each driven by one of these phases and each connected to a portion of the first diaphragm edge which is specific thereto, the correction of this movement can be performed in real time. Specifically, each phase controls a portion of the edge of the diaphragm, and by modulating the amplitude of the current in this phase, the amplitude of this portion of the diaphragm edge is modulated.

The invention claimed is:

1. A ripple diaphragm circulator comprising:

a body inside which there is a chamber internal to the body, this chamber comprising at least one inlet opening for flowing fluid into the chamber and at least one outlet opening for flowing fluid out of the chamber;

a flexible diaphragm placed in the chamber so as to be able to ripple there between first and second edges of the diaphragm, the first diaphragm edge being located closer to the fluid inlet opening than to the fluid outlet opening and the second diaphragm edge being located closer to the fluid outlet opening than to the fluid inlet opening; the circulator further comprising:

an actuating mechanism comprising at least one motor and at least one mechanical linking part linking the motor to the first edge of the diaphragm so as to move it in a reciprocating motion relative to the body in order to produce a ripple on the diaphragm propagating from the first diaphragm edge to the second diaphragm edge, wherein the circulator also includes a detection device for detecting at least one value representative of a movement of the first diaphragm edge relative to the body, the detection device being functionally linked to a motor power supply unit, this power supply unit being arranged to deliver at least one electrical power supply signal to the motor according to a detection signal delivered to the power supply unit by said detection device, this detection signal being dependent on said at least one detected value, the circulator further comprising a fluid deflector positioned in the chamber and connected to the body in order to direct fluid arriving in the chamber via the fluid inlet opening toward the first diaphragm edge in a direction running from this first diaphragm edge to the second diaphragm edge, said detection device comprising a sensor for detecting the movement of the first diaphragm edge, said sensor being attached to the fluid deflector.

2. The ripple diaphragm circulator as claimed in claim 1, wherein the detection device is arranged so that said detection signal delivered to the power supply unit is dependent on measurements taken by said sensor, the sensor being a Hall effect sensor, resolver sensor, incremental encoder, an optical sensor using a light beam to measure a movement parameter of a diaphragm surface, a laser sensor using a laser beam to measure a movement parameter of a diaphragm surface, an optical sensor using a light beam to measure a movement parameter of a target, a laser sensor using a laser beam to measure a movement parameter of a target, an accelerometer, a capacitive sensor, an inductive sensor, a resistive sensor, a camera associated with an image analysis system, an infrared sensor, or an eddy current sensor.

3. The ripple diaphragm circulator as claimed in claim 2, wherein said sensor of the detection device has a target mechanically linked to the diaphragm, the value representative of a movement of the first diaphragm edge varying during the movement of this target relative to the body of the circulator.

4. The ripple diaphragm circulator as claimed in claim 1, wherein said sensor is:

a sensor for measuring mechanical force;

a magnetic field sensor;

a voltage sensor;

a rotation/angular movement sensor; or a current sensor.

5. The ripple diaphragm circulator as claimed in claim 1, wherein the actuating mechanism-is arranged so as to define a maximum amplitude of the reciprocating motion of the first edge of the diaphragm that is variable according to said at least one electrical power supply signal delivered to the motor.

6. The ripple diaphragm circulator as claimed in claim 1, wherein the actuating mechanism includes said motor and an electromechanical assembly for varying an amplitude, said electromechanical assembly comprising said part linking the motor to the first edge of the diaphragm, said electromechanical assembly being arranged so as to define a maximum amplitude of the reciprocating motion of the first edge of the diaphragm that is variable according to a maximum amplitude setpoint delivered by an amplitude control unit to said electromechanical assembly.

7. The ripple diaphragm circulator as claimed in claim 1, wherein said value representative of the movement of the first diaphragm edge relative to the body is a maximum amplitude of movement measured from the first edge of the diaphragm relative to the body.

8. The ripple diaphragm circulator as claimed in claim 1, wherein the diaphragm has a shape, the diaphragm being a discoidal shape, a rectangular shape, or a tubular shape.

9. The ripple diaphragm circulator as claimed in claim 1, wherein the motor includes a movable rotor including at least one permanent magnet and a stator comprising at least one stator coil suitable for generating a magnetic flux in response to said at least one motor electrical power supply signal, this motor electrical power supply signal being delivered to said at least one coil by the motor power supply unit.

10. The ripple diaphragm circulator as claimed in claim 1, wherein the detection device is arranged so as to detect the respective positions of a plurality of points on the diaphragm relative to the body.

11. The diaphragm circulator as claimed in claim 10, wherein the detection device is arranged so as to collect images of a longitudinal profile of the diaphragm extending between the first and second edges of the diaphragm in order to detect said positions of a plurality of points on the diaphragm, these points being part of said longitudinal profile of the diaphragm.

12. The diaphragm circulator as claimed in claim 10, wherein the detection device is arranged so as to collect images of a surface of the diaphragm extending between the first and second edges of the diaphragm in order to detect said positions of a plurality of points on the diaphragm, these points being part of a surface shape of the diaphragm in three dimensions so as to define a three-dimensional image of this diaphragm and its change over time.

13. A ripple diaphragm circulator comprising:

a body inside which there is a chamber internal to the body, this chamber comprising at least one inlet opening for flowing fluid into the chamber and at least one outlet opening for flowing fluid out of the chamber;

a flexible diaphragm placed in the chamber so as to be able to ripple there between first and second edges of the diaphragm, the first diaphragm edge being located closer to the fluid inlet opening than to the fluid outlet opening and the second diaphragm edge being located closer to the fluid outlet opening than to the fluid inlet opening; the circulator further comprising:

an actuating mechanism comprising at least one motor and at least one mechanical linking part linking the motor to the first edge of the diaphragm so as to move it in a reciprocating motion relative to the body in order to produce a ripple on the diaphragm propagating from the first diaphragm edge to the second diaphragm edge, wherein the circulator also includes a detection device for detecting at least one value representative of a movement of the first diaphragm edge relative to the body, the detection device being functionally linked to a motor power supply unit, this power supply unit being arranged to deliver at least one electrical power supply signal to the motor according to a detection signal delivered to the power supply unit by said detection device, this detection signal being dependent on said at least one detected value, and wherein the actuating mechanism includes said motor and an electromechanical assembly for varying an amplitude, said electromechanical assembly comprising said part linking the motor to the first edge of the diaphragm, said electromechanical assembly being arranged so as to define a maximum amplitude of the reciprocating motion of the first edge of the diaphragm that is variable according to a maximum amplitude setpoint delivered by an amplitude control unit to said electromechanical assembly.

14. The ripple diaphragm circulator as claimed in claim 13, wherein the detection device is arranged so that said detection signal delivered to the power supply unit is dependent on measurements taken by a sensor, said sensor being a Hall effect sensor, resolver sensor, incremental encoder, an optical sensor using a light beam to measure a movement parameter of a diaphragm surface, a laser sensor using a laser beam to measure a movement parameter of a diaphragm surface, an optical sensor using a light beam to measure a movement parameter of a target, a laser sensor using a laser beam to measure a movement parameter of a target, an accelerometer, a capacitive sensor, an inductive sensor, a resistive sensor, a camera associated with an image analysis system, an infrared sensor, or an eddy current sensor.

* * * * *